US010567887B2

(12) United States Patent
Gilligan

(10) Patent No.: US 10,567,887 B2
(45) Date of Patent: Feb. 18, 2020

(54) PLASMA SPEAKER

(71) Applicant: Paul Gilligan, Dublin (IE)

(72) Inventor: Paul Gilligan, Dublin (IE)

( * ) Notice: Subject to any disclaimer, the term of this patent is extended or adjusted under 35 U.S.C. 154(b) by 0 days.

(21) Appl. No.: 16/304,594

(22) PCT Filed: Jun. 21, 2017

(86) PCT No.: PCT/EP2017/065309
§ 371 (c)(1),
(2) Date: Nov. 27, 2018

(87) PCT Pub. No.: WO2018/050304
PCT Pub. Date: Mar. 22, 2018

(65) Prior Publication Data
US 2019/0215616 A1 Jul. 11, 2019

(30) Foreign Application Priority Data
Sep. 15, 2016 (GB) ..... 1615702.6

(51) Int. Cl.
*H04R 23/00* (2006.01)
*H04R 1/30* (2006.01)
*B03C 3/38* (2006.01)

(52) U.S. Cl.
CPC ..... *H04R 23/004* (2013.01); *B03C 3/38* (2013.01); *H04R 1/30* (2013.01); *H04R 2201/003* (2013.01)

(58) Field of Classification Search
CPC .. H04R 23/004; H04R 1/30; H04R 2201/003; B03C 3/38
(Continued)

(56) References Cited

U.S. PATENT DOCUMENTS 4,460,809 A * 7/1984 Bondar ..... H04R 23/004 381/111
5,966,452 A * 10/1999 Norris ..... B06B 1/20 381/71.1
2013/0223647 A1* 8/2013 Akino ..... H04R 23/004 381/98

FOREIGN PATENT DOCUMENTS

CN 202218397 U 5/2012
JP 2010141858 A1 6/2010
WO 2009097068 A1 8/2009

OTHER PUBLICATIONS

Forte, M., et al., "Optimization of a dielectric barrier discharge actuator by stationary and non-stationary measurements of the induced flow velocity: application to airflow control," Experimental Methods and their Applications to Fluid Flow, vol. 43, Issue 6, Aug. 2007, pp. 917-928.

(Continued)

*Primary Examiner* — Sean H Nguyen
(74) *Attorney, Agent, or Firm* — Withrow & Terranova, P.L.L.C.

(57) ABSTRACT

A speaker (10) comprises an enclosure (8) defining an internal volume (11); and at least one sound generator (7), the sound generator (7) comprising one or more surfaces defining an air-path conduit (15) through which air operably passes in and out of the internal volume. The sound generator (7) further comprises a plurality of electrodes comprising at least one air-exposed electrode (1, 4) and at least one insulated electrode (2, 3). A voltage source (6) is configured to generate an electrical field between the at least one air-exposed electrode (1, 4) and the at least one insulated electrode (2, 3, 70) to operatively generate a plasma proximal (100) to the plurality of electrodes and within the air-path conduit (15).

25 Claims, 15 Drawing Sheets

(58) Field of Classification Search
USPC ..... 381/167
See application file for complete search history.

(56) References Cited

OTHER PUBLICATIONS

Roth, Reeth, et al., "The Physics and Phenomenology of Paraelectric One Atmosphere Uniform Glow Discharge Plasma (OAUGDP) Actuators for Aerodynamic Flow Control," 43rd AIAA Aerospace Sciences Meeting and Exhibit, Jan. 2005, Reno, Nevada, AIAA, 11 pages.
Suzen, Y.B., et al., "Numerical Simulations of Flow Separation Control in Low-Pressure Turbines using Plasma Actuators," AIAA Aerospace Sciences Meeting and Exhibit, Jan. 2007, Reno, Nevada, AIAA, 8 pages.
International Search Report and Written Opinion for International Patent Application No. PCT/EP2017/065309, dated Aug. 30, 2017, 11 pages.
International Preliminary Report on Patentability for International Patent Application No. PCT/EP2017/065309, dated Mar. 28, 2019, 8 pages.
Chirayath, Ved, et al., "Plasma Actuated Unmanned Aerial Vehicle," Poster Presentation, AIAA Affiliates Meeting, Stanford Department of Aeronautics & Astronautics, Apr. 26, 2011, 1 page.

* cited by examiner

PLASMA SPEAKER

This application is a 35 USC 371 National Phase filing of International Application No. PCT/EP2017/065309, filed Jun. 21, 2017, the disclosure of which is incorporated herein by reference in its entirety.

FIELD

The present invention relates to a plasma speaker for converting an electrical signal into a corresponding sound signal.

BACKGROUND

The majority of currently available speakers or electro-acoustic transducers comprise a moving membrane to transfer sound energy to the surrounding air. The mass of the moving membrane along with other nonlinearities (e.g. magnetic nonlinearity and suspension nonlinearities), introduces distortion/coloration into the sound.

In addition, due to the mechanics of the moving membrane, no currently available single speaker can adequately and efficiently cover the entire audio spectrum. It is therefore necessary to use a number of speakers in tandem to cover the entire audio spectrum (Woofer, Midrange, Tweeter). Using multiple speakers can result in significant overlap at different frequency ranges which also distorts the intended sound.

In order to overcome the issues with these known speakers, several attempts have been made to achieve a speaker which has an effective zero mass (except for the mass of the moving air). One method of creating a massless speaker is to use an atmospheric plasma to move the air.

An atmospheric plasma is most readily created by imposing a large electric field over a volume of air. The electric field causes a breakdown of the air molecules. Once the air molecules breakdown, they become ionized and will move in the direction of an applied electric field gradient. The moving ions will transfer their momentum to the surrounding air. By modulating the electric field, the air can be made move in time to an audio signal, thereby creating a sound wave.

Three known types of plasma speakers are:

- Plasma Arc: these speakers use an electric arc which is modulated using an audio signal. An electric arc eventually breaks down due to erosion of the contacts caused by the high electric fields involved; further, the use of an electric arc is quite hazardous.
- Tesla Coil: these speakers are based on the Tesla coil, they cause a lot of electrical interference and they are very impractical to commercialize.
- Flame: these speakers use a flame (Bunsen burner) to create sound. By modulating the ions within the flame using an applied high voltage, sound can be generated. Again the commercialization of such a device is very difficult and the use of a flame is quite hazardous.

While differing in their approach, generally it is considered that these kinds of plasma speakers are very impractical and have significant performance limitations, e.g. in frequency range and volume of the generated sound.

For example, none of these known plasma speakers are able to produce sufficient volume at the lower end of the audio spectrum (less than 2.5 kHz). Therefore, these plasma speakers have been restricted for use as Tweeters (High Frequency speakers).

A DBD (Dielectric Barrier Discharge) is a known device for producing a plasma between electrodes. The plasma is typically formed on an insulating surface between two parallel plate electrodes to which a large voltage is applied (greater than air breakdown electric field). DBD is primarily aimed at surface treatment to enhance wettability of materials preproduction or for surface sterilization in medical applications. DBD can be formed in air, other gas or at low pressure. Much of the research on DBD involves stabilizing the plasma formation (e.g. removal of micro discharges) to form a homogeneous plasma required for accurate surface treatment.

Plasma actuators are also known, which are derived from the DBD. The plasma actuators are devices for manipulating air flow using a pair of electrodes comprising one insulated, or encapsulated, electrode and one electrode exposed to air. An electric field is generated between the two electrodes which causes a motion of the air above to the actuator surface, in the direction of the electric field gradient (generally towards the insulated electrode). This airflow is a type of wall jet.

The airflow is generated by a momentum transfer from the plasma ions, moving along the lines of the electrical field, to the air close to the actuator.

Electroosmotic type flow model by Suzen (Numerical Simulations of Flow Separation Control in Low-Pressure Turbines using Plasma Actuators, Suzen, Y B, Huang, P G, Ashpis, D E, 45th AIAA Aerospace Sciences Meeting and Exhibit 8-11 Jan. 2007, Reno, Nev.), the Paraelectric flow model by Roth (The physics and phenomenology of paraelectric one atmosphere uniform glow discharge plasma (Oaugdp™) actuators for aerodynamic flow control, Roth, J Reece, Dai, Xin, Rahel, Jozef, Sherman, Daniel M, AIAA PAPER 2005-0781), and the model by Alonso Chirayath (Plasma Actuated Unmanned Aerial Vehicle, Chirayath, V, Alonso, Dr J. Stanford University, Dept of Physics, 2010, 2011, NASA Grant funded) involving different species ionization rates for positive/negative voltages, are examples of theories for explaining how the moving ions transfer a momentum to air.

According to the model by Suzen, electrons follow the electric field lines until they reach the surface of the insulator/air exposed electrode (depending on polarity). When they reach the insulator surface, they distribute to try to cancel the applied electric field. The ions are a lot slower and do not travel very far per AC cycle. According to this theory, the interaction between the insulator surface charge and the ions causes the momentum transfer to the air. The overall plasma volume is neutral within a ns timescale.

When the air exposed electrode is negative, electrons travel to the insulator surface and build up a surface charge. The surface charge redistributes in such a way to create a net momentum (caused by ions) away from the air exposed electrode.

When the air exposed electrode is positive, electrons migrate from the insulator surface to the air exposed electrode (following electric field lines) and ions move towards the insulator surface away from the air exposed electrode (nearly tangential to electric field lines). Ions are responsible for nearly all the momentum transfer. The momentum is usually not equal in both cycles; this creates a push/smaller push action on the air.

Plasma actuators are involved in flow control applications, mostly in aerospace (e.g. aircraft wings). By using the nonlinearity of an electric field across an atmospheric plasma, a flow is imparted to the surrounding air. This airflow can be used to reduce turbulence in the airflow over the actuator, by creating a suction/blowing effect over the plasma surface.

One of the primary limitations of the plasma actuators in flow control applications is the low speed of the generated airflow. The majority of research is aimed at enhancing the airflow speed, mostly through modification to: electrode gap size, electrode size, dielectric type, metal types, serrated electrodes, actuator voltage and frequency, AC voltage wave shape (sine, triangular, sawtooth, etc).

Several names are associated with plasma actuators: SDBD (Single Dielectric Barrier Discharge), sliding SDBD (where an additional AC or DC Voltage is used to increase force, at least marginally), OAUGDP (One Atmosphere Uniform Glow Discharge Plasma, used for example for surface treatment), Micro DBD (MEMs scale device). There are several modified air exposed electrode SDBD designs, e.g. serpentine or triangular designs (mainly directed to generation of micro vortex for air flow control).

SUMMARY

According to a first aspect of the present invention there is provided a speaker according to claim 1.

According to a second aspect of the present invention there are provided headphones according to claim 25.

The speaker according to the first aspect is a massless speaker, i.e. a speaker which has no moving parts except for the generated plasma. Because it is massless, the speaker can reproduce sound more accurately than known speakers having a mechanical movable membrane.

Further, the speaker according to the first aspect can cover the entire audio spectrum (even at the lower end thereof, less than 2.5 kHz). Hence, the speaker can replace existing speaker combinations of Woofer, Midrange and Tweeter with a single smaller unit. Also the volume range of the generated sound is improved.

Compared to existing plasma tweeters, speakers according to the present invention can push a large volume of air within the air-path conduit. For example, for a conduit with an area of 50 $mm^2$, air can be pushed at between 1-10 m/s, to generate 75 dB and possibly 84 dB SPL (Sound Pressure Level) @ 1 m. By comparison, a plasma tweeter only moves a tiny volume of air around the tip of the discharge (a few $mm^2$)—this is satisfactory for low volume at 2.5 kHz audio, but will not push enough air to create audible sound at lower frequencies. It is also possible to extend operation of the speaker into the ultrasound region.

Furthermore, the structure of the speaker according to the first aspect is easily scalable and it has a size which is significantly smaller in comparison to the majority of known speakers. The size can be even reduced to MEMs (Micro electromechanical systems) level or lower, thus allowing for a micro sized design or headphones, as well as allowing a reduction of the operational voltage of the speaker.

The small size of the speakers according to the present invention can also make it easier to produce effects such as a directional sound.

The speaker according to the first aspect is also significantly safer in comparison to the known plasma tweeters.

In general it will be appreciated that a speaker according to the first aspect is significantly less complex, smaller, easier and cheaper to construct, with a reduced bill of materials, and it is also more reliable and safer compared to the known speakers, while at the time can be usefully employed to deliver a high quality sound transduction and volume even at the lower frequencies of the audio spectrum.

BRIEF DESCRIPTION OF DRAWINGS

Embodiments of the invention will now be described, by way of example, with reference to the accompanying drawings, in which.

Figure 1:
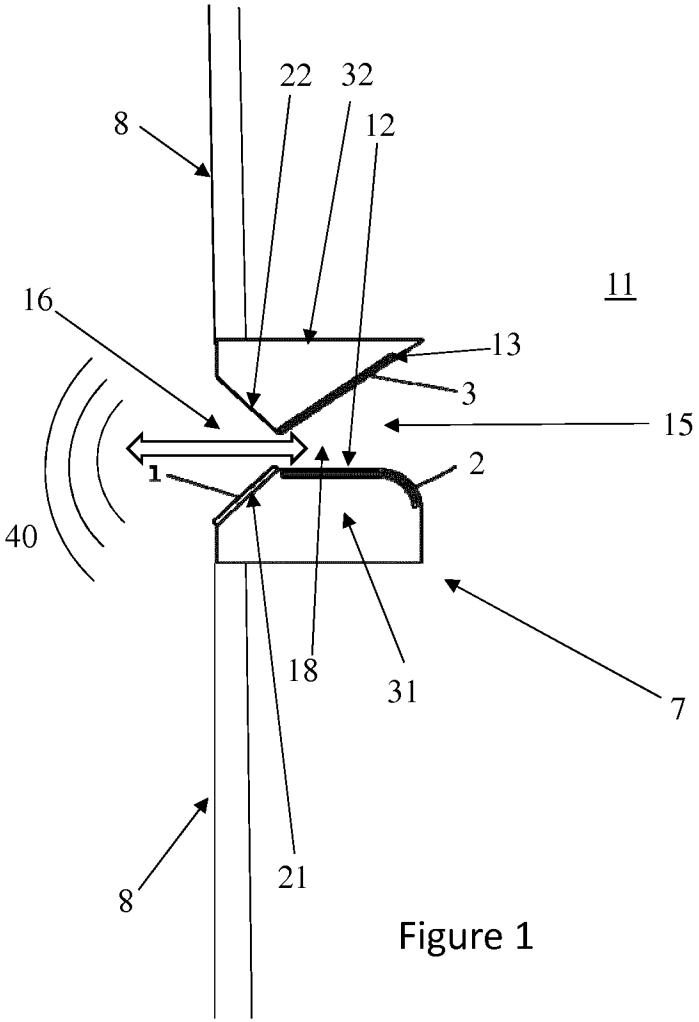
FIG. 1 illustrates partially section of a first exemplary speaker according to the present invention.

It should be noted that in the detailed description that follows, identical or similar components, either from a structural and/or functional point of view, can have the same reference numerals, regardless of whether they are shown in different embodiments of the present disclosure; it should also be noted that in order to clearly and concisely describe the present invention, the drawings may not necessarily be to scale and certain features of the disclosure may be shown in somewhat schematic form.

DETAILED DESCRIPTION

With reference to the attached Figures, the present disclosure is related to a speaker 10 comprising an enclosure 8 defining an internal volume 11. The internal volume 11 is preferably filled with gas, such as air, but it can be also filled with other fluids.

The speaker 10 further comprises at least one sound generator 7. The sound generator 7 comprises one or more surfaces defining an air-path conduit 15 through which air can operably pass in and out of the internal volume 11.

In the exemplary embodiments illustrated in FIGS. 1-6, the sound generator 7 comprises a first block 31 and a second block 32 separated from each other. The block 31 comprise surfaces 12, 21 which are separated from surfaces 13, 22 of the block 32 to define the air-path conduit 15 therebetween.

In particular, the surfaces 21 and 22 are separated and opposed from each other so as to define an access 16 to the air-path conduit 15 towards the internal volume 1 (for allowing the air to enter the air-path conduit 15 from the outside of the enclosure 8). The surfaces 13 and 12 are separated and opposed to each other so as to define a gap 18 of the air-path conduit 15 therebetween.

Preferably, the surface 21 is inclined relative to the adjacent surface 12 of the block 31, and the surface 22 is inclined relative to the adjacent surface 13 of the block 32. More preferably, the surfaces 21, 22 are inclined so as to decrease the distance therebetween along a direction towards the gap 18.

In the present description, the term "inclined" relative to a surface means having a leasing or slope, or forming an angle relative to such surface; hence, the term "inclined" encompasses "leaned", "tilted", "angled", "slope", "transversal", "bended", "curved" relative to the surface.

In the exemplary embodiments illustrated in FIGS. 1-2 and 4-5, the surface 21 is tilted relative to the adjacent surface 12 of the block 31, and the surface 22 is tilted relative to the adjacent surface 13 of the block 32.

Figure 3:
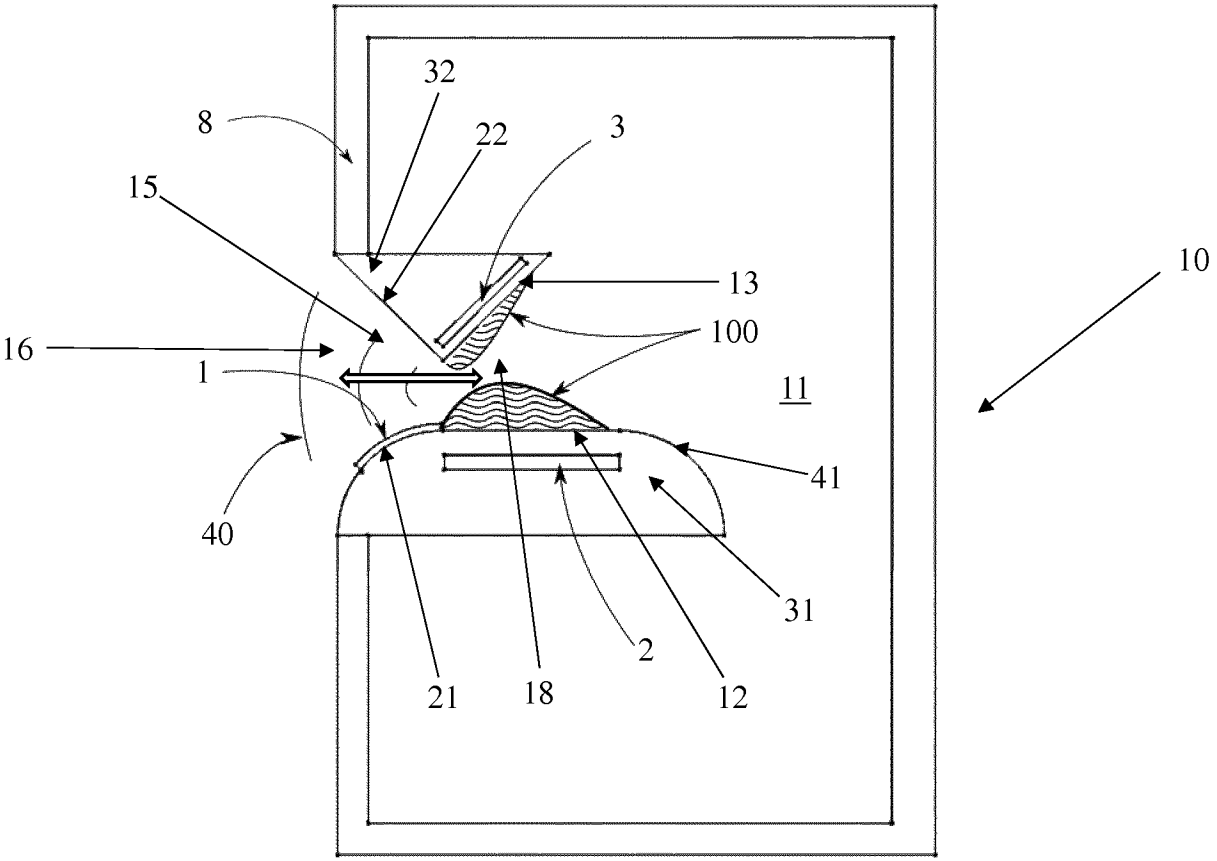
FIG. 3 illustrates a section of a second exemplary speaker according to the present invention.

In the exemplary embodiments illustrated in FIG. 3, the surface 21 is curved towards the internal volume 11, while the surface 22 is tilted relative to the surface 13.

Figure 6:
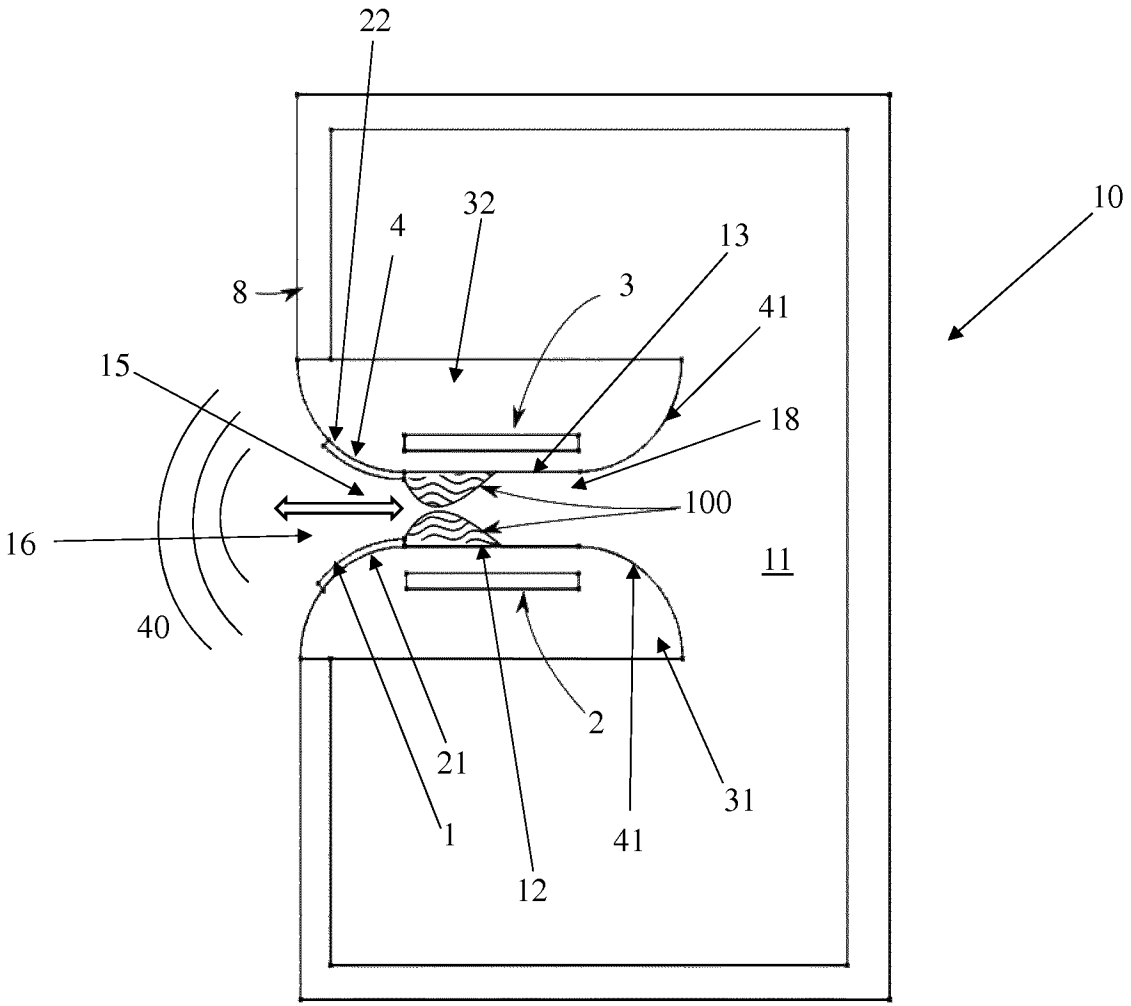
FIG. 6 illustrates a section of a fourth exemplary speaker according to the present invention.

In the exemplary embodiment illustrated in FIG. 6, the surfaces 21 and 22 are curved relative to the respective surfaces 12 and 13.

Figure 2:
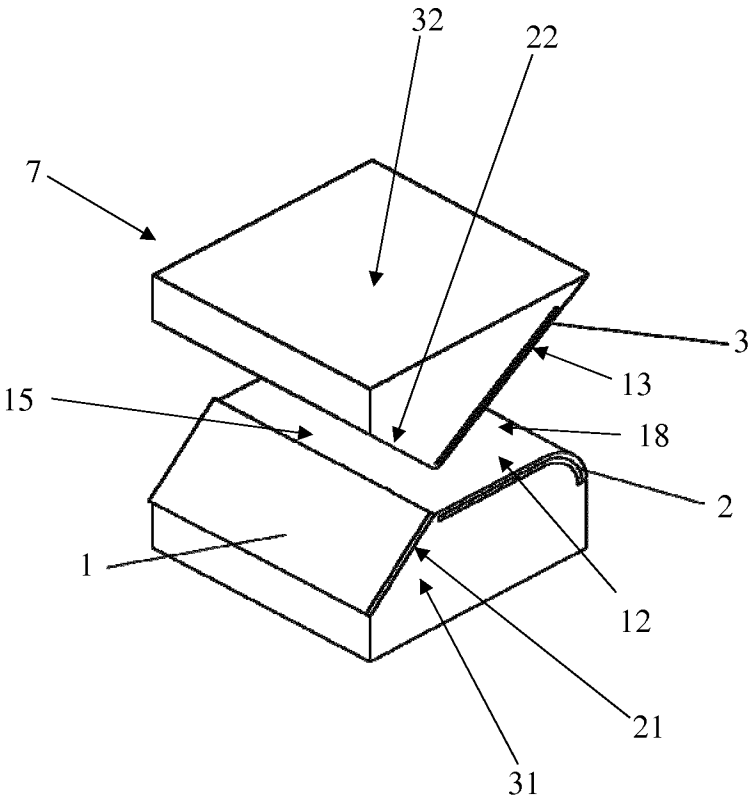
FIG. 2 illustrates a sound generator of the speaker illustrated in FIG. 1.

In the exemplary embodiments illustrated in FIGS. 1-2 and 3, the surface 13 of the block 32 is arranged transversally to the opposed surface 12 of the block 31 in such a way that the distance there between increases along a direction towards the internal volume 11 of the enclosure 8. In this way, the gap 18 enlarges along such direction.

Figure 4:
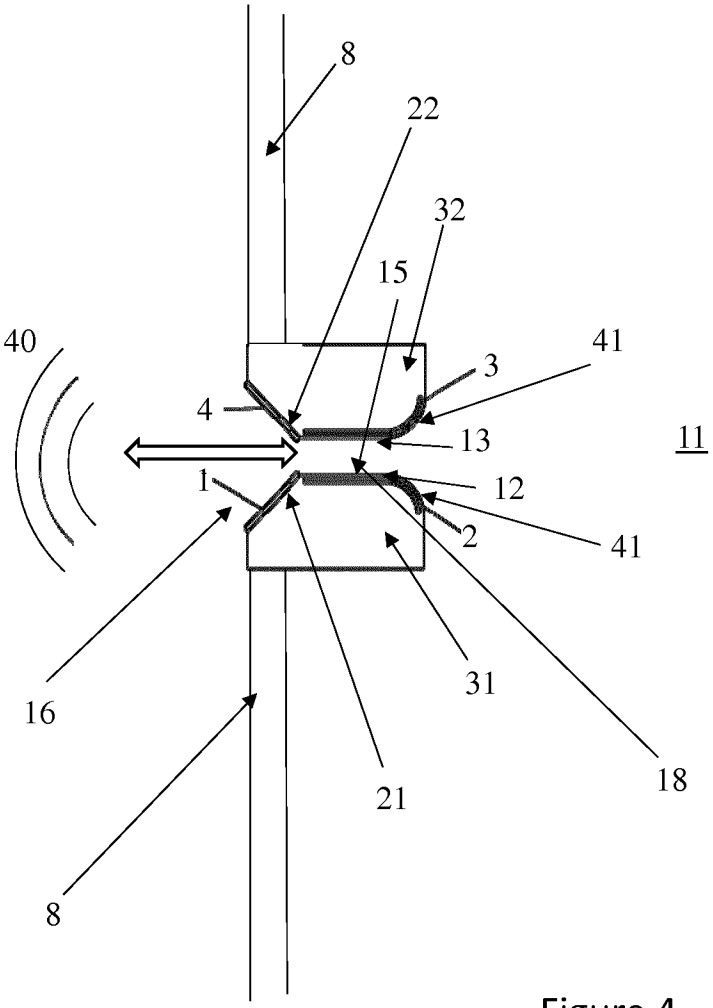
FIG. 4 illustrates partially a third exemplary speaker according to the present invention.
Figure 5:
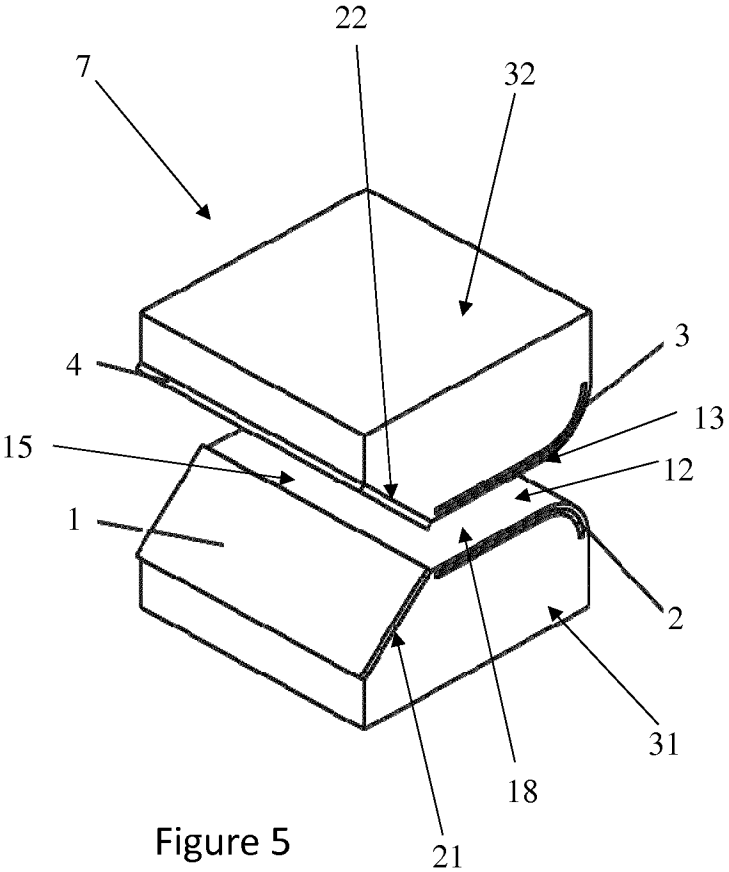
FIG. 5 illustrates a sound generator of the speaker illustrated in FIG. 4.

In the exemplary embodiments illustrated in FIGS. 4-5 and 6, the surfaces 12 and 13 comprise parallel flat tracts and ends 41 curved towards the internal volume 11. In particular, the ends 41 are curved in such a way to enlarge the end of the gap 18 towards the internal volume 11.

Figure 9:
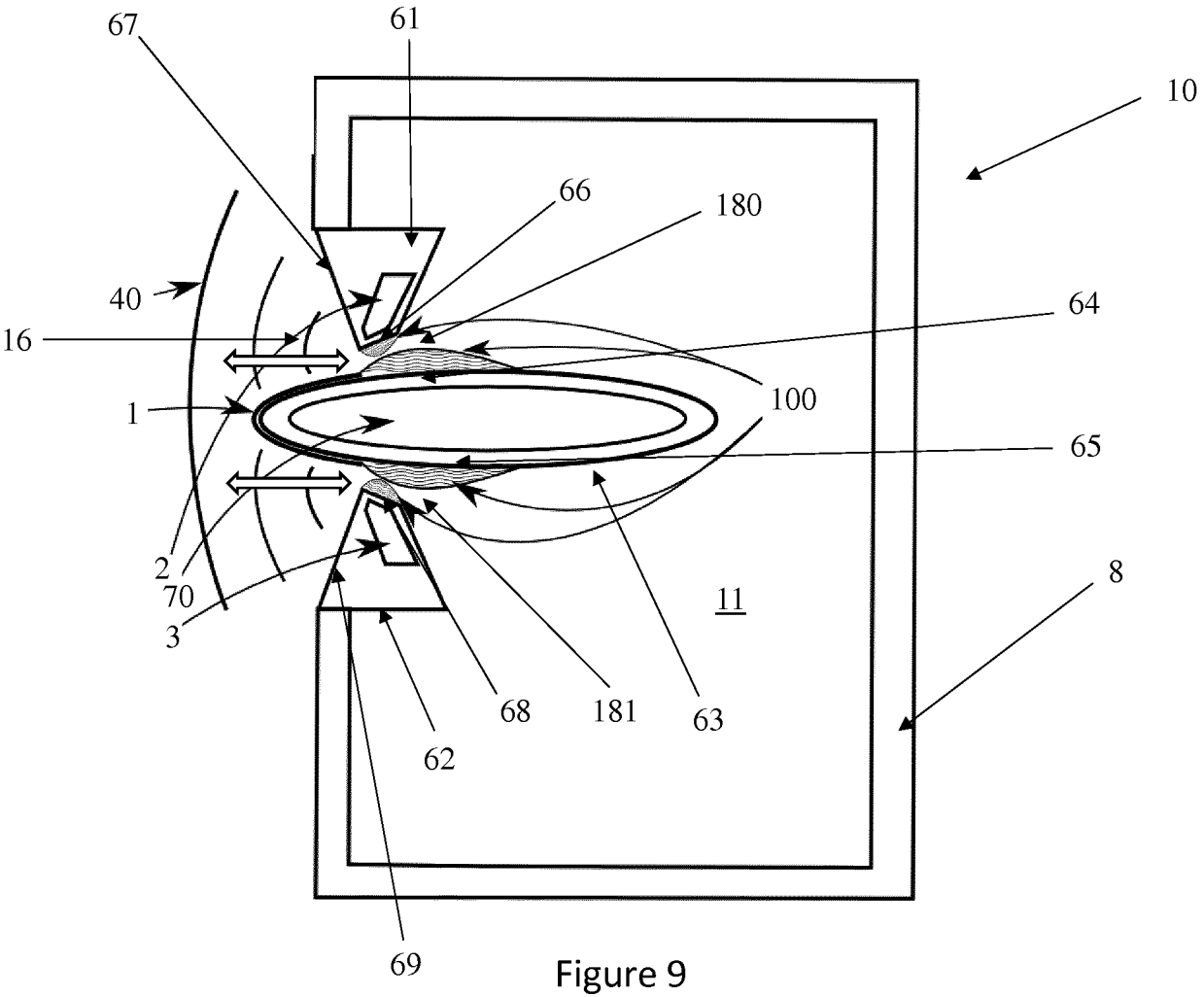
FIG. 9 illustrates a section of a sixth exemplary speaker according to the present invention.
Figure 10:
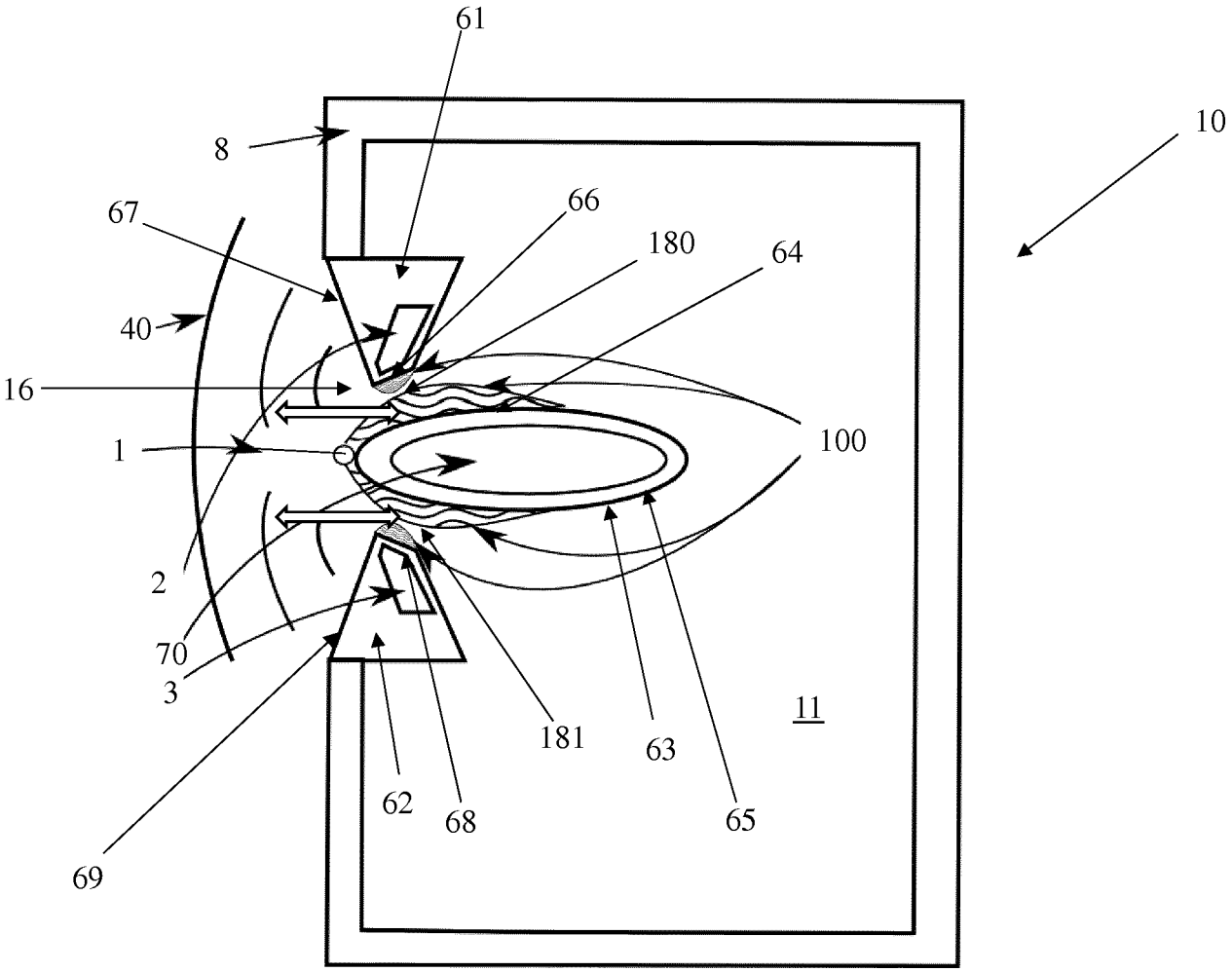
FIG. 10 illustrates a section of a seventh exemplary speaker according to the present invention.

In the embodiments illustrated in FIGS. 9 and 10, the sound generator 7 comprises a first block 61 and a second block 62 separated from each other. The sound generator 7 further comprises a third block 63 arranged between and separated from the first and second blocks 62, 63.

Separated surfaces of the blocks 61, 62, 63 define the air-path conduit 15. In particular, the block 63 comprises opposed surfaces 64 and 65. The block 61 comprises surfaces 66 and 67 separated from the surface 64, and the block 62 comprises surfaces 68 and 69 separated from the surface 65. The surfaces 66 and 64 defines therebetween a first gap 180 of the air-conduit path 15, and the surfaces 68 and 65 defines therebetween a second gap 181 of the air-conduit path 15.

The surfaces 67 and 69 are separated from each other and from the surfaces 64 and 65 so as to define an access 16 to the air-path conduit 15 towards the internal volume 11.

In the illustrated exemplary embodiments of FIGS. 9-10, the block 63 has an oval shape, but it could have other suitable shape such as a spherical or rectangular shape.

The surfaces 67 and 69 are tilted relative to the surfaces 66 and 68, respectively; in particular, the surfaces 67 and 69 are tilted so as to decrease the distance therebetween from the access 16 to the gaps 180, 181. In this way, the air-path conduit 15 decreases from the access 16 to the gaps 180 and 181.

Alternatively, the surfaces 67 and 69 may be curved so as to decrease the distance therebetween from the access 16 to the gaps 180 and 181.

The surfaces 66 and 68 are arranged so as their distance from the corresponding surfaces 64 and 65 of the block 63 increases along a direction towards the internal volume 11. In this way, the gaps 180, 181 enlarge along such direction.

Figure 13:
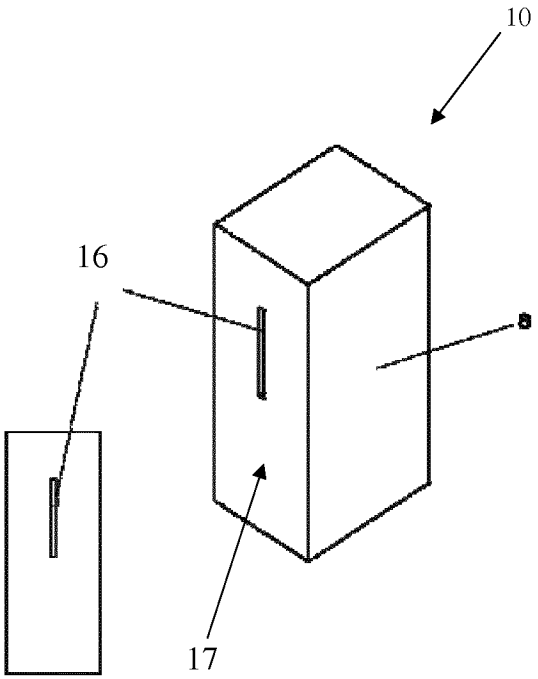
FIG. 13 illustrates the enclosure of an exemplary speaker according to the present invention.

FIG. 13 illustrates for example an enclosure 8 into which a sound generator 7 according to one of the of the previously disclosed embodiments can be mounted, in such a way that the access 16 to the air-flow conduit 15 is available at a wall 17 of the enclosure 8. The illustrated enclosure 8 can be for example a sealed box 8.

Figure 8:
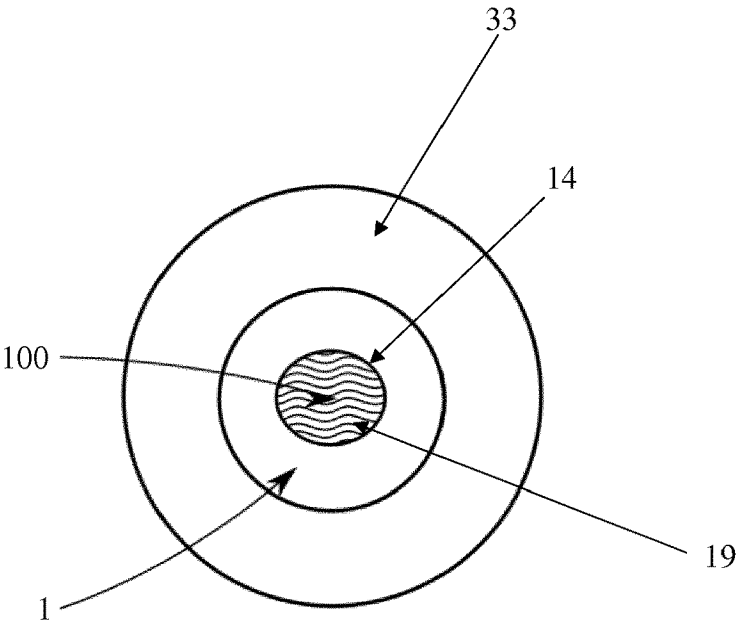
FIG. 8 illustrates a front view of a sound generator of the speaker illustrated in FIG. 7 (the enclosure of FIG. 7 is not shown)
Figure 7:
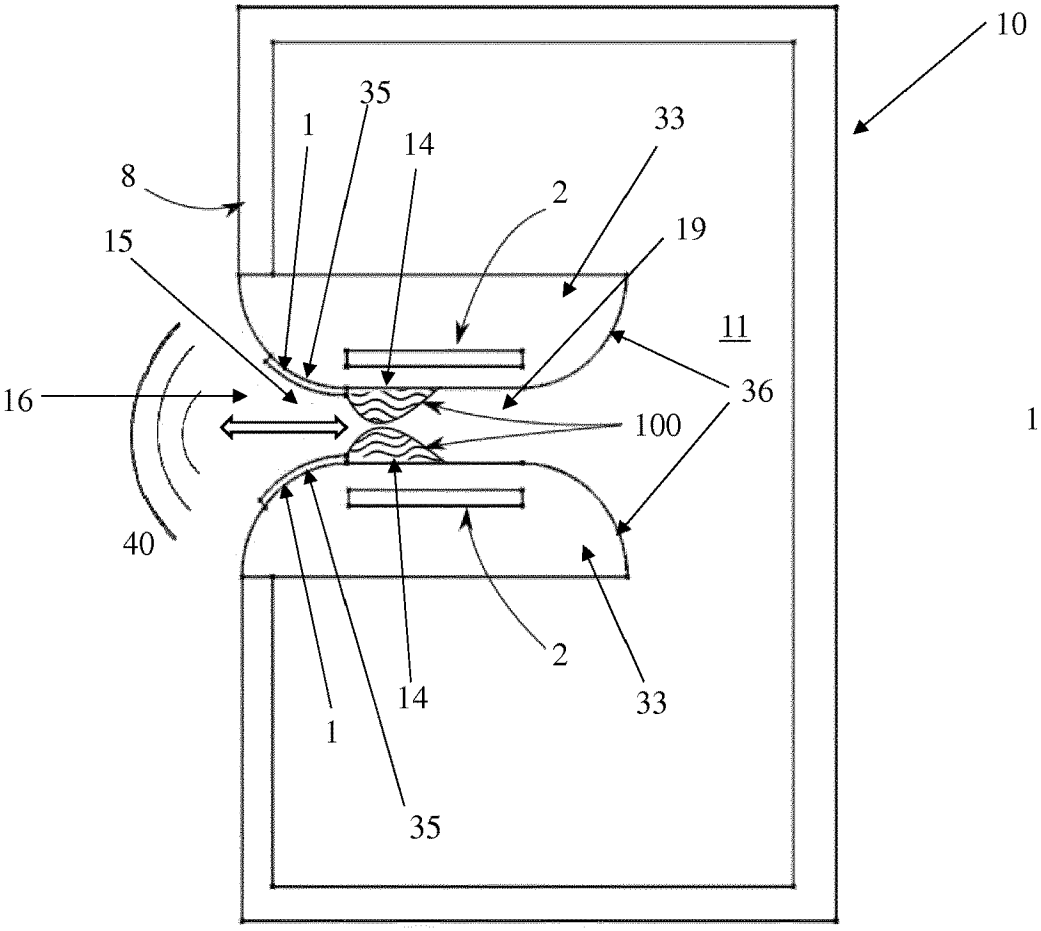
FIG. 7 illustrates a section view of a fifth exemplary speaker according to the present invention.

In the exemplary embodiment illustrated in FIGS. 7-8, the sound generator 7 comprises a block 33. The block 33 comprises a cylindrical surface 24 and curved surfaces 35 and 36 which are arranged at opposed ends of the cylindrical surface 24.

These surfaces 24, 35, 36 define the air-path conduit 15. In particular, the curved surface 25 defines an access 16 to the air-path conduit 15 towards the internal volume 11, the cylindrical surface 24 defines a central cylindrical hole 19 of the air-path conduit 15, and the curved surface 36 defines an end portion of the air-path conduit 15 towards the internal volume 11.

Preferably, the surface 35 is curved so as to enlarge the air-path conduit 15 from the cylindrical hole 19 towards the access 16.

Preferably, the surface 36 is curved so as to enlarge the air-path conduit 15 from the cylindrical hole 19 towards the internal volume 11.

With reference to the attached Figures, the sound generator 7 further comprises a plurality of electrodes which comprise at least one air-exposed electrode 1, 4 and at least one insulated electrode 2, 3, 70. The electrodes 2, 3 and 70 can be insulated with any suitable non-electrically conducting material.

Preferably, each of the electrodes has its own extended conductive surface. The electrodes can have any suitable shape; for example, but not limited to, the electrodes can be flat, straight, plate, serrated, strip or thin-wire electrodes.

For example, but not limited to, the air-exposed electrodes 1-4 may be made of copper or other electrical conductor/semi-conductor, the insulated electrodes 2, 3 can be encapsulated in Polyimide (e.g. Kapton) or ceramic or any other insulating or semi-conductive material.

The speaker 10 further comprises voltage source means 6 configured to generate an electrical field between the at least one air-exposed electrode 1, 4 and the at least one insulated electrode 2, 3, 70 so as to operably generate a plasma 100 proximal to the plurality of electrodes and within the air-path conduit 15.

The plurality of electrodes of the sound generator 7 are arranged relative to one another and the air-path conduit 15 such that the electrical field, in addition to generating the plasma 100 within the air-path conduit 15, induces a movement of the ions of the generated plasma 100 towards or away from the internal volume 11 of the enclosure 8 according to the modulation of the electrical field.

In this way, the moving ions can transfer a momentum to the particles of surrounding air, such as to force an airflow through the air-path conduit 15 that is directed towards or away from the internal volume 11.

Preferably, the at least one insulated electrode 2, 3, 70 is arranged below a corresponding one of the surfaces defining the air-path conduit 15 and the at least one air-exposed electrode 1,4 is arranged within the air-path conduit 15 offset relative to the at least one insulated electrode 2, 3, in such a way that the electrical field therebetween induces the movement of the ions of the plasma towards the internal volume 11.

In the exemplary embodiments illustrated in FIGS. 1-6, the sound generator 7 comprises a first insulated electrode 2 which is arranged below the surface 12 of the block 31, and a second insulated electrode 3 which is arranged below the surface 13 of the block 32.

The insulated electrodes 2 and 3 are separated from the corresponding surfaces 12 and 13 by insulating material, e.g. dielectric material; for example, in the illustrated embodiments the insulated electrodes 2 and 3 are encapsulated into the insulating material of the corresponding blocks 31 and 32.

Preferably, the insulated electrodes 2 and 3 are parallel to the corresponding surfaces 12 and 13 below which they are arranged. Nonetheless, in variants of such embodiments, the insulated electrode(s) may tilt to increase the electric field gradient further away from the exposed electrode(s).

In the exemplary embodiments illustrated in FIGS. 1-3, the sound generator 7 further comprises one air-exposed electrode 1 which is placed on the surface 21 of the block 31.

In this way, the air-exposed electrode 1 is arranged within the air-path conduit 15 offset relative to the insulated electrode 2; in particular, the air-exposed electrode 1 is arranged between the access 16 to the air-path conduit 15 and the surface 12 below which the insulated electrode 2 is arranged.

In FIGS. 1-2, since the surface 21 is tilted relative to the adjacent surface 12, the air-exposed electrode 1 is also tilted relative to such surface 12.

In FIG. 3, since the surface 21 is curved relative to the surface 12, the air-exposed electrode 1 placed thereon is also curved relative to such surface 12.

The voltage source means 6 is configured to generate the electrical field between the air-exposed electrode 1 and the insulated electrodes 2, 3.

Since the air-exposed electrode 1 is offset relative to the insulated electrodes 2, 3, the electrical field lines are directed away the air-exposed electrode 1 and enter the gap 18.

Following these field lines, the generated plasma 100 extends at least partially along the surface 12 below which the insulated electrode 2 is arranged. The insulated electrode 3 lifts the plasma 100 upwards, so as the plasma 100 extends at least partially also along the surface 13. Depending on the strength of the electrical field, the insulated electrode 3 also contributes to the generation of the plasma 100 in combination with the air-insulated electrode 1.

The ions of the plasma 100 are created at the point of largest electrical field, i.e. at the air-exposed electrode 1; the electrical field lines induce a movement of the created ions away from the air-exposed electrode 1 and directed into the gap 18.

The moving ions transfer their momentum to the surrounding air particles, in such a way to generate an airflow passing through the air-path conduit 15 and directed towards the internal volume 11.

In practice, while travelling along the electrical field lines, the ions have tangential force components directed into the gap 18 and, therefore, towards the internal volume 11 accessible by the gap 18 itself. Hence, the plasma 100 pushes the surrounding air, in such a way to force the airflow through the air-path conduit 15 and directed towards the internal volume 11.

The exemplary sound generator 7 illustrated in FIGS. 4-6 comprises an air exposed electrode 4 in addition to the air-exposed electrode 1.

This additional air-exposed electrode 4 is placed on the surface 22 of the block 32.

In this way, the air-exposed electrode 4 is arranged within the air-path conduit 15 offset to the insulated electrode 3; in particular, the air-exposed electrode 4 is arranged between the access 16 and the surface 13 below which the insulated electrode 3 is arranged.

In FIGS. 4-5, since the surface 22 is tilted relative to the adjacent surface 13, the air-exposed electrode 4 is also tilted relative to such surface 13.

In FIG. 6, since the surface 22 is curved relative to the adjacent surface 13, the air-exposed electrode 4 placed thereon is also curved relative to such surface 13.

The voltage source means 6 is configured to generate the electrical field directed from each of the air-exposed electrodes 1, 4 to the insulated electrodes 2, 3. Since the air-exposed electrodes 1, 4 are offset relative to the insulated electrodes 2, 3, the electrical field lines are directed away from the air-exposed electrodes 1, 4 and enter the gap 18.

Following these field lines, the generated plasma 100 extends at least partially along the surfaces 12 and 13. Further, the insulated electrode 3 lifts the plasma 100 generated along the surface 12 upwards and the insulated electrode 2 lifts the plasma 100 generated along the surface 13 downwards. In this way, the plasma 100 widely extends along the surfaces 12, 13 and also in the remaining space of the gap 18 between these surfaces 12, 13.

The ions of the plasma 100 are created at the point of largest electrical field, i.e. at the air-exposed electrodes 1 and 4; the electrical field lines induce a movement of the created ions away from the air-exposed electrodes 1, 4 and directed into the gap 18.

The moving ions transfer their momentum to surrounding air particles, such as to generate an airflow through the air-path conduit 15 and directed towards the internal volume 11.

In the exemplary embodiment illustrated in FIGS. 9-10, the sound generator 7 comprises a first insulated electrode 2 which is arranged below the surface 66 of the block 61, a second insulated electrode 3 which is arranged below the surface 68 of the block 62, and a third insulated electrode 70 which is arranged below the opposed surfaces 64, 65 of the oval block 63.

The insulated electrodes 2, 3 and 70 are encapsulated into the insulating material of the corresponding blocks 61, 62 and 63.

The sound generator 7 further comprises one air-exposed electrode 1 which is arranged into the air-path conduit 15 adjacent to the gaps 180 and 181, between the access 16 and the surfaces defining the gaps 180, 181.

In FIG. 9, the air-exposed electrode 1 is a curved electrode laying on the oval block 63, while in FIG. 10 the air-exposed electrode 1 is a wire arranged in front of the block 63.

In this way, the air-exposed electrode 1 is arranged within the air-path conduit 15 offset relative to the insulated electrodes 2, 3, 70.

The voltage source means 6 is configured to generate the electrical field between the air-exposed electrode 1 and the insulated electrodes 2, 3, 70.

Since the air-exposed electrode 1 is offset relative to the insulated electrodes 2, 3, 70 the electrical field lines are directed away the air-exposed electrode 1 and enter the gaps 180 and 181.

Following these field lines, the generated plasma 100 extends at least partially along the surfaces 64 and 65 below which the insulated electrode 70 is arranged. The insulated electrode 2 lifts the plasma 100 upwards from the surface 64, so as the plasma 100 extends at least partially also along the surface 66.

The insulated electrode 3 lifts the plasma 100 downwards from the surface 65, so as the plasma 100 extends at least partially also along the surface 68. Depending on the strength of the electrical field, the insulated electrodes 2, 3 also contribute to the generation of the plasma 100 in combination with the air-insulated electrode 1.

The ions of the plasma 100 are created at the point of largest electrical field, i.e. at the air-exposed electrode 1; the electrical field lines induce a movement of the created ions away from the air-exposed electrode 1 and directed into the gaps 180 and 181.

The moving ions transfer their momentum to the surrounding air particles, in such a way to generate an airflow through the air-path conduit 15.

In practice, while travelling along the electrical field lines, the ions have tangential force components directed into the gaps 180, 181 and, therefore, towards the internal volume 11 accessible by the gaps 180, 181 themselves. Hence, the plasma 100 pushes the surrounding air, in such a way to force the airflow passing through the air-path conduit 15 and directed towards the internal volume 11.

In the exemplary embodiment illustrated in FIGS. 7-8, the sound generator 7 comprises an insulated cylindrical electrode 2 which is arranged below the surface 14 defining the cylindrical hole 19. In particular, the cylindrical electrode 2 is separated from the corresponding surface 14 by insulating material, e.g. dielectric material; for example, in the illustrated embodiment the electrode 2 is encapsulated into the insulating material of the block 33.

The sound generator 7 further comprises an air-exposed circular electrode 1 arranged on the curved surface 35, in such a way that the extended conductive surface of the circular electrode 1 is curved relative to cylindrical surface 14.

The voltage source means 6 is configured to generate the electrical field directed from the circular air-exposed electrode 1 to the insulated cylindrical electrode 2. Since the air-exposed circular electrode 1 is offset relative to cylindrical electrode 2, the electrical field lines are directed away from the air-exposed circular electrode 1 and enter into the to the cylindrical hole 19.

Following these field lines, the generated plasma 100 extends at least partially along the surface 14 below which the cylindrical insulated electrode 2 is arranged. The ions of the plasma 100 are created at the point of largest electrical field, i.e. at the air-exposed circular electrode 1; the electrical field lines induce a movement of the created ions away from the circular air-exposed electrode 1 and directed into the hole 19.

The moving ions transfer their momentum to surrounding air particles, such as to generate an airflow through the air-path conduit 15 and direct that airflow towards the internal volume 11.

In practice, while travelling along the electrical field lines, the ions have tangential force components directed into the hole 19 and, therefore, towards the internal volume 11 accessible by the hole 19 itself. Hence, the plasma 100 pushes the surrounding air, in such a way as to force the airflow passing through the air-path conduit 15 and direct it towards the internal volume 11.

The voltage source means 6 of the speaker 10 according to the present invention is further configured to modulate the generated electrical field in response to a provided electrical sound signal 25, to generate a corresponding sound signal 40 from the speaker 10.

The electrical audio signal 25 used for modulating the electrical field can have a frequency into the audio range, e.g. between 20 Hz and 20 k Hz, so as to produce an audio signal 40.

The electrical audio signal 25 can have a frequency greater than 20 k Hz, so as to produce an ultrasound signal 40 at frequencies up to at least 3 MHz.

By modulating the magnitude of the electrical field, the generated plasma 100 vibrates.

In particular, when the magnitude of the modulated electrical field increases the moving ions of the plasma 100 are accelerated, thus augmenting the force exerted by the plasma 100 to push the surrounding air into the internal volume 11.

As it will be understood, the airflow through the air-gap conduit 15 and directed towards the internal volume 11 is accelerated thereby, causing a compression of the gas filling the internal volume 11 of the enclosure 8.

The compressed gas exerts a restoring force on the air pushed into the internal volume 11 by the plasma 100 (or vice versa).

When the magnitude of the modulated electrical field decreases, the pushing force exerted by the plasma 100 on the air also decreases until it is overcome by the restoring force. Accordingly, the airflow towards the internal volume 11 starts to slow down until the restoring force reverses its direction out of the enclosure 8.

The sound signal 40 from the speaker 10 is resultant from such a modulation of the air flow through the air-path conduit 15, in and out of the internal volume 11 (as schematically illustrated by a double arrow in the figures).

The walls of the enclosure 8 are suitable for canceling/absorbing pressure waves that could be generated into the volume 11 by the modulation of the airflow; damping material may also by arranged onto the internal surfaces of the walls of the enclosure 8.

In practice, the gas filling the enclosure 8 acts like a spring, while the modulated air flowing through the air-path conduit 15 acts like a moving vibrating mass.

Hence, like a whistle effect, the air-path conduit 15 and the enclosure 8 act a like an audio tuned circuit where the tuning frequency is determined by the size (length/width) of the air-path conduit 15 and the size of the enclosure 8.

The tuning frequency can be selected to maximize the gain at the desired operational frequency. In practice, the sizes of the air-path conduit 15 and/or of the enclosure 8 can be selected to maximize the Q factor of the audio tuned circuit realized by the enclosure 8 and the air-path conduit 15 themselves. As will be appreciated, with audio, the lower the Q factor the better.

This can be achieved for example by dimensioning a small size air-path conduit 15 (meaning a reduced mass of air therein).

For example, the dimensions of a sound generator 7 as illustrated in FIGS. 1-6 and can be approximately 6 mm wide by 45 mm high, where the gap 18 is approximately between 0.5-3 mm and preferably between 2-3 mm. In this case, the enclosure 8 can be approximately 120×70×60 mm. Referring to FIG. 13, the length of the access slot 16 can be approximately 45 mm.

With reference to the exemplary sound generator 7 illustrated in FIGS. 7-8, the size of the cylindrical hole 19 can be dimensioned very small, so that the plasma 100 can move all the air in the hole 19 at once and stop any back pressure wave coming out through the center of the hole 19 (which could cancel with the generated sound signal 40). This sound generator 7 is particularly suitable to be realized at MEMs size; indeed, its scale is very small, a few mm across at most.

In case of generation of an ultrasonic audio signal 40, the enclosure 8 can be also dimensioned smaller to maximize the audio Q factor.

With reference to the exemplary sound generator 7 illustrated in FIGS. 1-6 and 9-10, by using the insulated electrode 3 in addition to the insulated electrode 2 the plasma generated into the gaps 18, 180, 181 extends, at least partially, along both the opposed surfaces defining such gaps.

In this way, the plasma can guide the airflow through the gaps 18, 180, 181 smoothly, i.e. avoiding or at least significantly reducing vortexes or turbulences. Since the sound signal 40 is produced by the modulation of the airflow through the air-path conduit 15, an improved airflow means an improved sound loudness/volume and quality.

The airflow through the air-path conduit 15 is further improved by having the air-exposed electrode 1 inclined relative to the surface 12 defining the gap 18. This avoids or at least significantly reduce turbulences or acceleration damping effects or boundary layer effects which are generally associated to the operation of pulling/pushing air across a surface.

For the same reason, the surface 13 of the block 32 illustrated in FIG. 1-3 is inclined along the extension of the gap 18 and can help to keep the airflow laminar.

With reference to the exemplary sound generator 7 illustrated in FIGS. 4-6, the additional air-exposed electrode 4 causes a doubling up of the plasma volume (or the sound generator 7 can generate the same plasma volume but with a reduced in size) in comparison to the sound generator 7 illustrated in FIGS. 1-3.

The additional air-exposed electrode 4 also increases the pushing force exerted by the moving ions on the surrounding air for forcing the airflow through the gap 18.

The air-exposed electrode 4 is inclined relative to the surface 13. This avoids or at least significantly reduce turbulences or acceleration damping effects on the airflow through the air-path conduit 15.

Also the curved ends 41 of the surfaces 12, 13 improve the airflow through the gap 18, by avoiding or at least reducing a slowing due to boundary layer effects.

With reference to the exemplary sound generators 7 illustrated in FIGS. 9-10, the presence of two gaps 180, 181 increase the volume of generated plasma 100.

With reference to the exemplary sound generator 7 illustrated in FIGS. 7-8, the plasma can guide the airflow through the cylindrical hole 19 smoothly, because the plasma at least partially extends along the cylindrical surface 14, The airflow through the air-path conduit 15 is further improved by having the circular air-exposed electrode 1 inclined relative to the cylindrical surface 14, and by having the curved surfaces 36.

The voltage source means 6 of the speaker 10 according to the present invention is configured to generate an electrical field having a sufficient level to operably generate the plasma 100 within the air-path conduit 15. The electric field shall be greater than the breakdown electrical field of air (or other gas in the air-path conduit 15), so as to ionize the air. Once ionized, the air will move in the direction of the electric field gradient.

Figure 11:
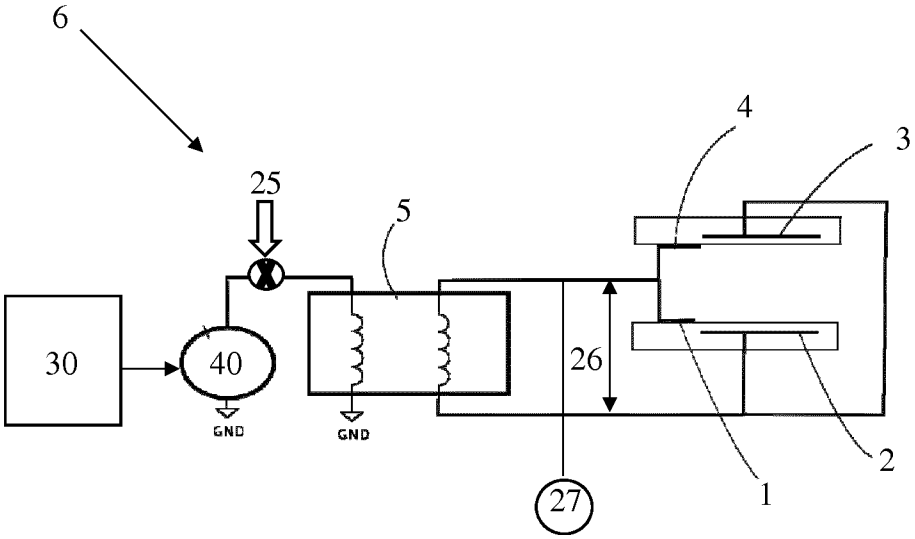
FIG. 11 schematically illustrates first exemplary voltage source means of the speaker according to the present invention.
Figure 12:
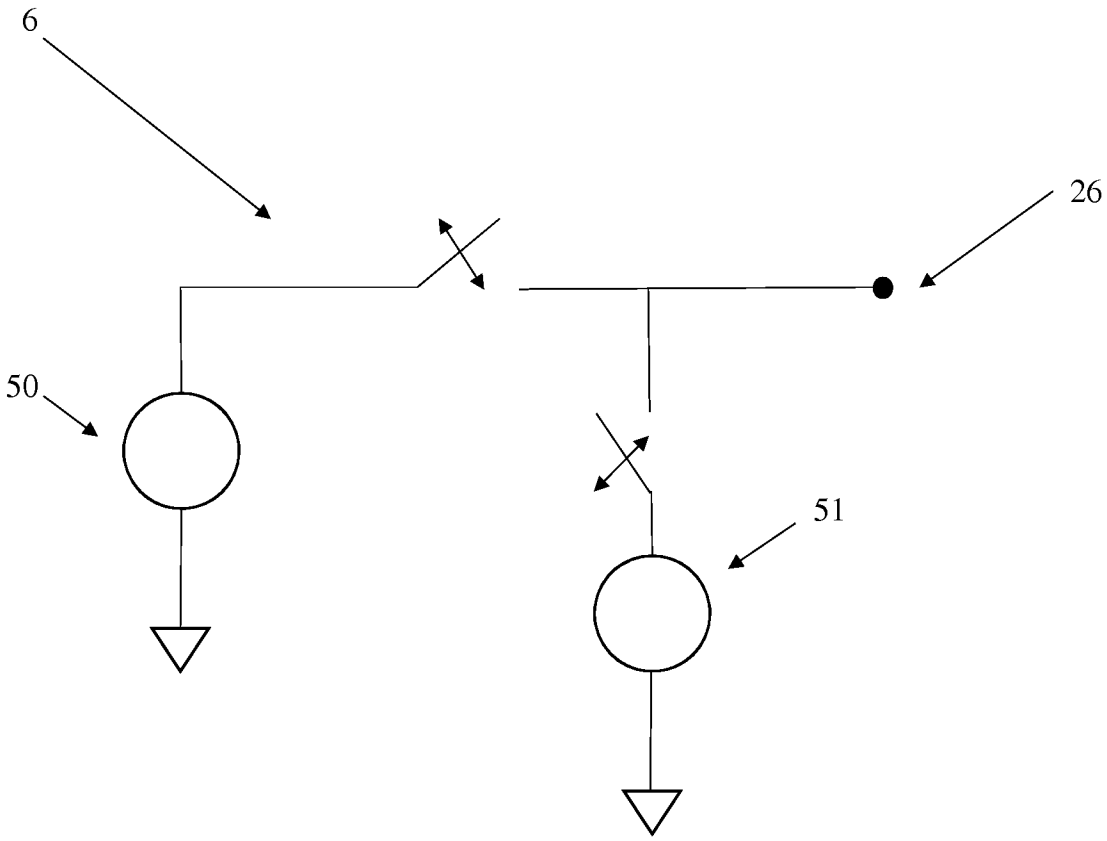
FIG. 12 schematically illustrates second exemplary voltage source means of the speaker according to the present invention.

With reference to the exemplary embodiments illustrated in FIGS. 11 and 12, the voltage source means 6 is configured to apply a supply voltage 26 between the one or more air-exposed electrodes 1,4 and the one or more insulated electrodes 2,3 of the sound generator 7.

For example, considering the breakdown electrical field of the air being about 3 kV/mm and a 0.5 mm dielectric, a minimum value of the supply voltage 26 required for generating the plasma is about 1.5 k V. A maximum voltage value can be set to avoid dielectric saturation, e.g. about 30 k V.

The voltage source means 6 illustrated in FIG. 11 is configured to generate a source signal 40 having a carrier frequency.

The voltage source means 6 further comprises a transformer 5, e.g. a flyback transformer 5, for amplifying the source signal 40 and generating the supply voltage 26 above the minimum voltage level required for generating the plasma 100.

Preferably, in order to reduce distortion of the generated sound 40, a bias level needs to be set to maintain the plasma at a minimum level. The bias level is determined by the geometry and electrical characteristics of the sound generator 7. The bias level can go to zero when no audio electrical signal 25 is present; no warm up time is necessary.

The bias level sets the balance point between the plasma force and the enclosure restoring force, a bit like a mid-point in a push pull amplifier, it ensures the plasma controls the force through the entire push pull cycle linearly. The plasma does not ignite until the air breakdown point is reached, so the minimum level (1.5 kV in the example above) is above the air breakdown point to start pushing. The bias point can be mid-way between this minimum and a maximum voltage. So say a range of 0.5*(0 kVmin−5 kVmax)+1.5 kV=4 kV.

It is also possible and more efficient vary the bias point based on a pre-distortion algorithm (Hammerstein Weiner) which effectively sets the bias point based on the incoming music stream level rather than fixing it to a preset level. Such an algorithm take the input signal, determines how much audio distortion this would generate (based on a model of the speaker) and then generates the opposite of the distortion to effectively cancel it out.

Distortion can also be reduced using methods such as voltage, current or optical feedback. Using optical feedback from the plasma light intensity level gives a much faster response time when compared to microphone feedback as used by currently available speakers.

The source signal 40 can be modulated by the electrical sound signal 25 at the primary side of the transformer 5, as illustrated in FIG. 11. Alternatively, the source signal 40 can be modulated by the electrical sound signal 25 at the secondary side of the transformer 5.

The source signal 40 can be an AC signal. In this case, the voltage source means 6 is preferably configured to modulate the amplitude of such signal 40 by using the electrical sound signal 25.

The source signal 40 can be a pulsed signal. For example, the source signal 40 can be a PWM signal or it can be generated by a PFM (Pulse Frequency Modulation) which varies frequency around the flyback transformer 5 resonant point; in practice, the slope of the transformer 5 is used to create a signal which looks like a PWM signal at the secondary side of the transformer 5.

The source signal 40 can also be generated by directly switching a DC high voltage, thus avoiding the use of the transformer 5; this is more applicable to MEMs sizes.

In case of a pulsed source signal 40, the voltage source means 6 is preferably configured to perform a pulse-width modulation to such signal 40 by using the electrical sound signal 25.

Preferably, the carrier frequency of the source signal 40 is greater than 15 kHz, and preferably greater than 18 k Hz. In this way, the source signal 40 does not introduce audible noise.

The carrier frequency may be one or some hundreds of k Hz. For example, the carrier frequency can be resonant to the primary circuit of the transformer 5, e.g. about 100 k Hz.

This can cause a larger push force one side of the resonant point than the other side, allowing a better bass response.

For example, the carrier frequency can be selected to match the spike frequency of the plasma (caused by plasma micro discharges), that typically may have a value of about 3 MHz. In this way, the current spike affecting the plasma 100 can be reduced.

In order to set the carrier frequency at the actual spike plasma frequency, the speaker 10 can comprise control means 30 configured to adjust the carrier frequency to a measured value corresponding to the actual frequency of spikes of the generated plasma 100.

In case that the speaker 10 is used for generating an ultrasound signal 40, a corresponding higher carrier frequency shall be selected for the source signal 40 is modulated by the ultrasound electrical signal 25. Alternatively, the ultrasound electrical signal 25 can be directly used as the source voltage signal 40.

The force exerted by the plasma 100 to push the air through the air-path conduit 15 depends by the amplitude/duration of the source signal 40.

The voltage source means 6 can be further configured to apply a DC voltage 27 to the plurality of electrodes of the sound generator 7, in addition to the supply voltage 26. In this way, the pushing force is increased, thus increasing the amplitude of the generated sound signal 40. In this case, the high voltage DC would need to be on the secondary side of the transformer 5, and so would need a separate DC supply.

The pushing force further depends to the plasma density. In order to increase the plasma density, the air in the air-path conduit 15 can be seeded with a suitable dust/aerosol. The aerosol/dust act as ionized particles which are transported by the imposed electric field, dragging the surrounding air along with it.

The voltage source means 6 illustrated in FIG. 12 is configured to first apply a source voltage 50 to the plurality of electrodes 1-4 for generating the plasma 100 in the air-path conduit 15. After the generation of the plasma 100, the voltage source means 6 is configured to switch from the source voltage 50 to, for example, a PWM signal 51.

The PWM signal 51 applied to the plurality of electrodes 1-4 is modulated by the electrical sound signal 25, in order to generate the sound signal 40.

Preferably, in this case the source voltage 50 comprises a series of nanoseconds pulses. The density of the plasma is determined by the nanosecond pulse energy, while the pushing force of the plasma depends on both the plasma density and the PWM signal cycle.

The speaker 10 according to the present invention can comprise a plurality of sound generators 7.

For example, the sound generators 7 can be arranged in series to increase the overall force exerted on the air. It is also possible to phase the different plasma stages to create a wave effect to multiply the force or to direct the sound signal 40.

Figure 15:
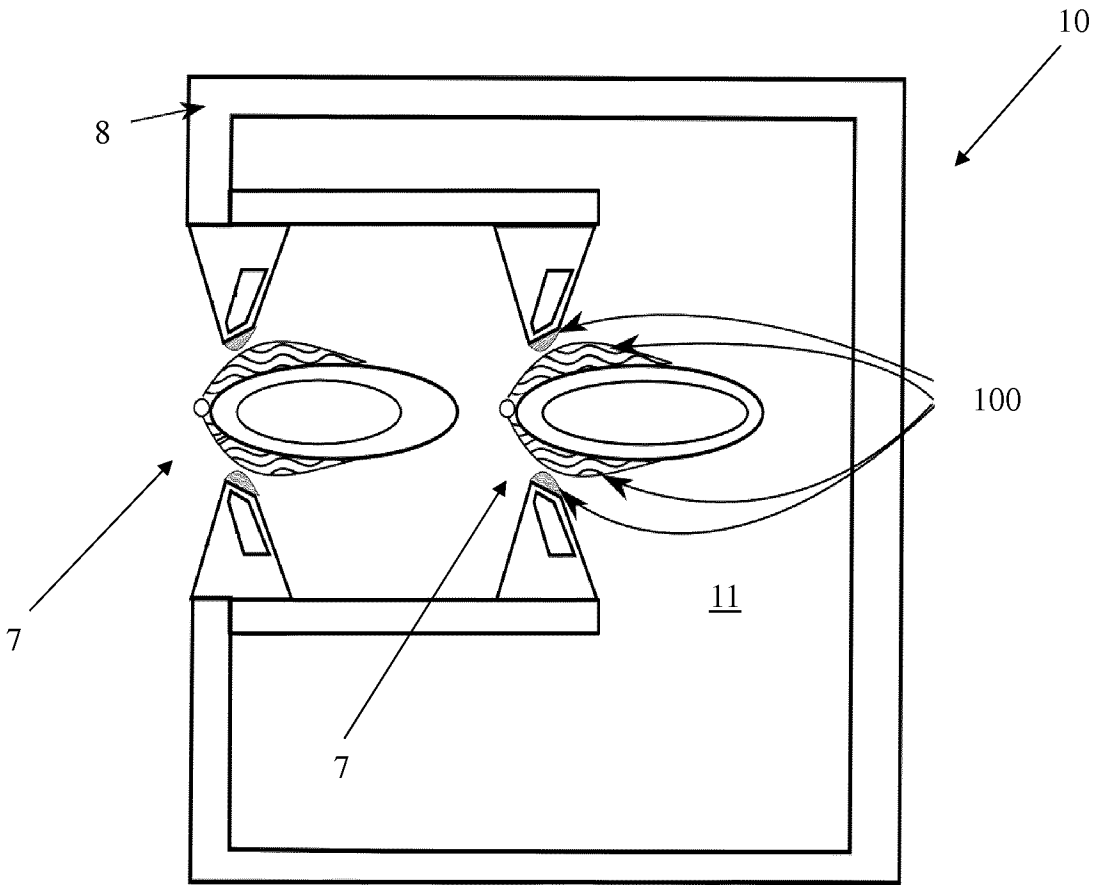

For example, FIG. 15 illustrates a speaker 10 comprising two sound generators 7 according to the exemplary embodiment illustrated in FIG. 10, which are arranged in series.

Further, the sound generators 7 can be arranged to each other so as to obtain a mesh/honeycomb structure. For example, FIG. 14 illustrates a speaker 10 comprising a plurality of generators 7 according to the exemplary embodiment illustrated in FIGS. 7-8.

Figure 14:
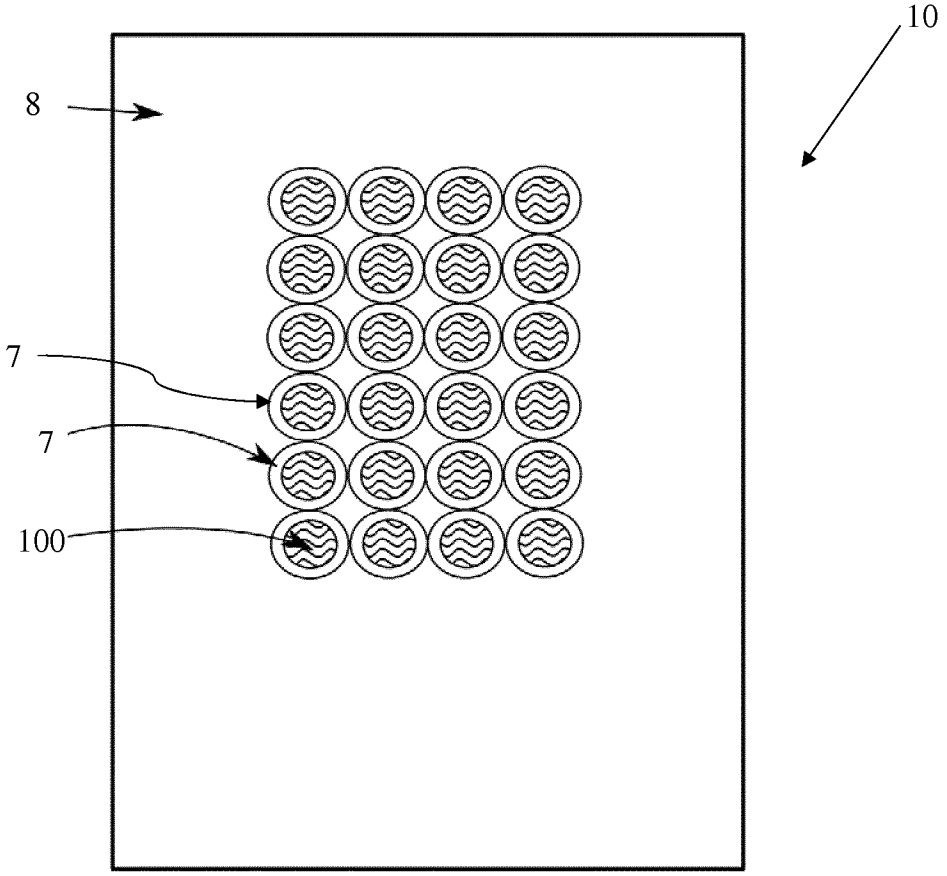
FIGS. 14 and 15 illustrate two exemplary embodiments of a speaker according to the present invention, comprising a plurality of sound generators.
Figure 16:
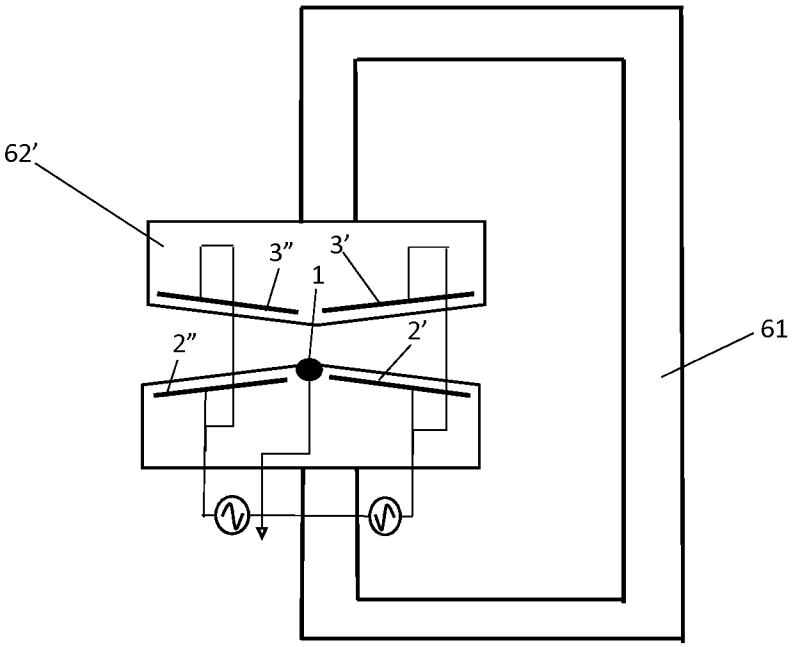
FIG. 16 illustrates a still further embodiment of a speaker according to the present invention comprising a plurality of sound generators.

Referring now to FIG. 16, in a still further embodiment, instead of multiple sound generators operating in parallel or in series as in FIGS. 14 and 15 respectively, the sound generators can be arranged to operate in anti-phase. Thus as shown in the example of FIG. 16, the driving signal between the exposed electrode 1 and rear electrodes 2',3' can be in anti-phase to the driving signal between the exposed electrode 1 and rear electrodes 2",3", so that air is actively pushed and pulled through the sound generators rather than only being actively pushed or pulled as in the above embodiments. It will be appreciated that while only a single common electrode 1 is shown in FIG. 16, multiple electrodes could also be employed. Equally, the electrodes 2',3' and 2",3" could be cylindrical and so would only need one connection to the driving signal.

In the embodiments illustrated and described above, the air exposed electrodes are shown towards the external face of the enclosure. In alternative embodiments, the position of the air-exposed electrodes and the insulated electrodes can be reversed, so the air-exposed electrode is located inside the enclosure and so protected from contact. In such embodiments, the speaker pulls air out of the enclosure and the enclosure provides a restoring force.

The blocks 31,32; 33; and 61,62 incorporating the electrodes can also be recessed within the enclosure more than shown in the illustrated embodiments and in some cases, a membrane could cover the gap 18 or access 16 to trap any generated ozone from discharging from the enclosure and to protect the electrodes from contact. Also, the air exposed electrode can also be grounded and the insulated electrode connected to high voltage—rather than vice versa.

It will be appreciated that the speaker generates ozone, and in some embodiments, the enclosure can be sealed airtight to prevent discharge. However, other techniques for dispersing ozone can be used, such as heating the air gap 18 to above about 100° C. or using a catalytic layer or using gasses such as helium or argon within the enclosure.

The invention claimed is:

1. A speaker comprising:

an enclosure defining an internal volume;

at least one sound generator, said sound generator comprising one or more surfaces defining an air-path conduit through which air operably passes in and out of the internal volume, the sound generator further comprising a plurality of electrodes comprising at least one air-exposed electrode and at least one insulated electrode;

voltage source means configured to generate an electrical field between said at least one air-exposed electrode and said at least one insulated electrode to operatively generate a plasma proximal to the plurality of electrodes and within the air-path conduit;

wherein:

the plurality of electrodes are arranged relative to one another and the air-path conduit such that a generated electric field operably induces a generated plasma to cause an airflow through said air-path conduit; and the voltage source means is further configured to modulate the electrical field in response to a provided electrical sound signal, so as to modulate air flow through the air-path conduit and generate a corresponding sound signal from the speaker.

2. The speaker according to claim 1, wherein:

said at least one insulated electrode is arranged below a corresponding one of said one or more surfaces defining the air-path conduit; and said at least one air-exposed electrode is arranged within the air-path conduit offset relative to said at least one insulated electrode.

3. The speaker according to claim 2, wherein said at least one air-exposed electrode is arranged within the air-path conduit between a surface corresponding to said at least one insulated electrode and an access to the air-path conduit.

4. The speaker according to claim 2, wherein said at least one air-exposed electrode is arranged within the air-path conduit adjacent and inclined relative to a surface corresponding to said at least one insulated electrode.

5. The speaker according to claim 1, wherein said one or more surfaces are configured so as the air-path conduit enlarges at its end towards the internal volume of the enclosure.

6. The speaker according to claim 5, wherein said one or more surfaces comprise curved ends towards the internal volume of the enclosure.

7. The speaker according to claim 1, wherein:

said one or more surfaces defining the air-path conduit comprise a first surface and a second surface opposed and separated from each other so as to define a first gap there between;

said at least one insulated electrode comprises at least a first insulated electrode arranged below said first surface and a second insulated electrode arranged below said second surface; and said at least one air-exposed electrode comprises at least a first air exposed electrode arranged within the air-path conduit and adjacent to said first gap.

8. The speaker according to claim 7, wherein said first air-exposed electrode is inclined relative to said first surface defining the first gap.

9. The speaker according to claim 7, wherein a distance between said first and second surfaces increases at least at the ends of the first and second surfaces towards the internal volume of the enclosure.

10. The speaker according to claim 7, wherein said at least one air-exposed electrode further comprises a second air-exposed electrode arranged within said air-path conduit and adjacent to said second surface.

11. The speaker according to claim 10, wherein said second air-exposed electrode is inclined relative to said second surface defining the first gap.

12. The speaker according to claim 7, wherein:

said one or more surfaces further comprise a third surface and a fourth surface opposed and separated from each other so as to define a second gap therebetween; and said at least a first air exposed electrode is arranged within the air-path conduit adjacent to said second gap.

13. The speaker according to claim 1, wherein said one or more surfaces comprise a surface which defines a hole of said air-path conduit, and wherein an arrangement of air-exposed and insulated electrodes comprises at least an insulated electrode arranged below said surface defining the hole and an air-exposed electrode arranged within the air-path conduit and adjacent to the hole.

14. The speaker according to claim 13, wherein said surface, said hole and said insulated electrode are cylindrical.

15. The speaker according to claim 13, wherein said air-exposed electrode is inclined relative to said surface.

16. The speaker according to claim 1, wherein said voltage source means is configured to generate a voltage source signal having a carrier frequency, and wherein said voltage source means is further configured to modulate said voltage source signal with said electrical sound signal so as to generate a supply voltage for said plurality of electrodes.

17. The speaker according to claim 16, wherein said carrier frequency is greater than 15 kHz, and preferably greater than 18 k Hz.

18. The speaker according to claim 16, wherein said voltage source means is further configured to apply an additional DC voltage to said plurality of electrodes.

19. The speaker according to claim 16, comprising control means configured to adjust the carrier frequency to a value corresponding to an actual spike frequency of the generated plasma.

20. The speaker according to claim 1, wherein said voltage source means is configured to:

apply to said plurality of electrodes a source voltage to operably generate the plasma;

switch from the source voltage to a DC voltage after the generation of the plasma; and modulate the DC voltage with said electrical sound signal.

21. The speaker according to claim 1, wherein said at least one sound generator comprises a plurality of sound generators arranged in series and/or phased to each other.

22. The speaker according to claim 1, wherein said electrical sound signal has a frequency in the range from 20 Hz to 20 k Hz.

23. The speaker according to claim 1, where said electrical sound signal has a frequency greater than 20 k Hz, and preferably up to 3 MHz.

24. The speaker of claim 1 wherein said speaker comprises at least one further sound generator located around a common air-path conduit and axially separated from one of said at least one sound generator, said at least one further sound generator being driven in anti-phase with said one of said at least one sound generator.

25. The speaker of claim 1 wherein at least one of said speaker is incorporated into headphones.

* * * * *